US009244386B2

(12) United States Patent
Sato et al.

(10) Patent No.: US 9,244,386 B2
(45) Date of Patent: Jan. 26, 2016

(54) DEVELOPING DEVICE AND IMAGE FORMING APPARATUS

(71) Applicant: FUJI XEROX CO., LTD., Tokyo (JP)

(72) Inventors: Kunihiko Sato, Kanagawa (JP); Yoko Miyamoto, Kanagawa (JP); Yoshiya Mashimo, Kanagawa (JP); Masaaki Takahashi, Kanagawa (JP); Sakon Takahashi, Kanagawa (JP); Nobumasa Furuya, Kanagawa (JP); Kazuhiko Arai, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 25 days.

(21) Appl. No.: 13/909,428

(22) Filed: Jun. 4, 2013

(65) Prior Publication Data

US 2014/0140739 A1 May 22, 2014

(30) Foreign Application Priority Data

Nov. 19, 2012 (JP) ..... 2012-253506

(51) Int. Cl.
*G03G 15/20* (2006.01)
*G03G 15/09* (2006.01)

(52) U.S. Cl.
CPC ..... *G03G 15/0921* (2013.01)

(58) Field of Classification Search
CPC G03G 15/0935; G03G 15/09; G03G 15/0921
USPC ..... 399/269
See application file for complete search history.

(56) References Cited

U.S. PATENT DOCUMENTS

| | | | | |
|---|---|---|---|---|
| 6,269,235 | B1 * | 7/2001 | Nishiyama | 399/267 |
| 9,026,011 | B2 * | 5/2015 | Kubo | G03G 15/0849 399/269 |
| 9,057,987 | B2 * | 6/2015 | Oda | G03G 15/09 1/1 |
| 2006/0222417 | A1 * | 10/2006 | Shimizu | 399/276 |
| 2011/0097116 | A1 * | 4/2011 | Itagaki et al. | 399/269 |
| 2012/0093543 | A1 * | 4/2012 | Ikeda et al. | 399/267 |

FOREIGN PATENT DOCUMENTS

JP A-2006-91161 4/2006

* cited by examiner

*Primary Examiner* — Walter L Lindsay, Jr.
*Assistant Examiner* — Frederick Wenderoth
(74) *Attorney, Agent, or Firm* — Oliff PLC

(57) ABSTRACT

A developing device includes a first developer holder and a second developer holder. The first developer holder is disposed so as to face an image holding member and rotates so as to move in a direction opposite to a direction of movement of the image holding member at a first facing portion. The second developer holder is disposed downstream from the first developer holder in the direction of movement of the image holding member so as to face the image holding member and rotates so as to move in the same direction as the image holding member moves at a second facing portion. A value obtained by dividing an amount of developer per unit area held on the first developer holder by a shortest distance between the image holding member and the first developer holder is approximately in a range from $1.00\times10^3$ kg/m$^3$ to $1.60\times10^3$ kg/m$^3$.

10 Claims, 7 Drawing Sheets

FIG. 5

| FIRST DEVELOPMENT ROLLER | | | SECOND DEVELOPMENT ROLLER | | | |
|---|---|---|---|---|---|---|
| MOS ($g/m^2$) | DRS ($\mu m$) | MOS/DRS ($\times 10^3$) ($kg/m^3$) | MOS ($g/m^2$) | DRS ($\mu m$) | MOS/DRS ($\times 10^3$) ($kg/m^3$) | TRANSFER EFFICIENCY |
| 250 | 140 | 1.79 | 240 | 200 | 1.20 | POOR |
| 250 | 160 | 1.56 | 240 | 200 | 1.20 | FAIR |
| 250 | 180 | 1.39 | 240 | 200 | 1.20 | GOOD |
| 250 | 240 | 1.04 | 240 | 200 | 1.20 | GOOD |
| 250 | 180 | 1.39 | 240 | 130 | 1.85 | GOOD |
| 250 | 180 | 1.39 | 240 | 170 | 1.41 | GOOD |
| 250 | 180 | 1.39 | 240 | 200 | 1.20 | GOOD |
| 300 | 240 | 1.25 | 280 | 180 | 1.56 | GOOD |
| 300 | 200 | 1.50 | 280 | 200 | 1.40 | FAIR |
| 300 | 160 | 1.88 | 280 | 200 | 1.40 | POOR |
| 300 | 240 | 1.25 | 280 | 240 | 1.16 | GOOD |
| 300 | 240 | 1.25 | 310 | 250 | 1.24 | GOOD |

FIG. 7

| V2/V1 | V3/V1 | (V2 + V1)/V1 | (V3 – V1)/V1 | TRANSFER EFFICIENCY |
|---|---|---|---|---|
| 2.25 | 1.5 | 3.25 | 0.5 | POOR |
| 2.0 | 1.5 | 3.0 | 0.5 | FAIR |
| 1.75 | 2 | 2.75 | 1 | GOOD |
| 1.5 | 2.5 | 2.5 | 1.5 | GOOD |
| 1.0 | 3 | 2.0 | 2.0 | GOOD |
| 1.0 | 3.75 | 2.0 | 2.75 | GOOD |
| 1.0 | 4.0 | 2.0 | 3.0 | FAIR |

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2012-253506 filed Nov. 19, 2012.

BACKGROUND

Technical Field

The present invention relates to developing devices and image forming apparatuses.

SUMMARY

According to an aspect of the invention, a developing device includes a first developer holder disposed so as to face an image holding member that holds an electrostatic latent image, the first developer holder rotating while holding a developer on a surface thereof so as to move in a direction opposite to a direction of movement of the image holding member at a first facing portion at which the first developer holder faces the image holding member; and a second developer holder disposed downstream from the first developer holder in the direction of movement of the image holding member so as to face the image holding member, the second developer holder rotating while holding the developer on a surface thereof so as to move in a direction the same as the direction of movement of the image holding member at a second facing portion at which the second developer holder faces the image holding member. A value obtained by dividing an amount of developer per unit area held on the first developer holder by a shortest distance between the image holding member and the first developer holder is approximately in a range from $1.00\times10^3$ kg/m$^3$ to $1.60\times10^3$ kg/m$^3$.

BRIEF DESCRIPTION OF THE DRAWINGS

Exemplary embodiments of the present invention will be described in detail based on the following figures, wherein:

FIG. 5 illustrates a table showing results of experiments;

FIG. 7 illustrates a table showing results of experiments.

DETAILED DESCRIPTION

Figure 1:
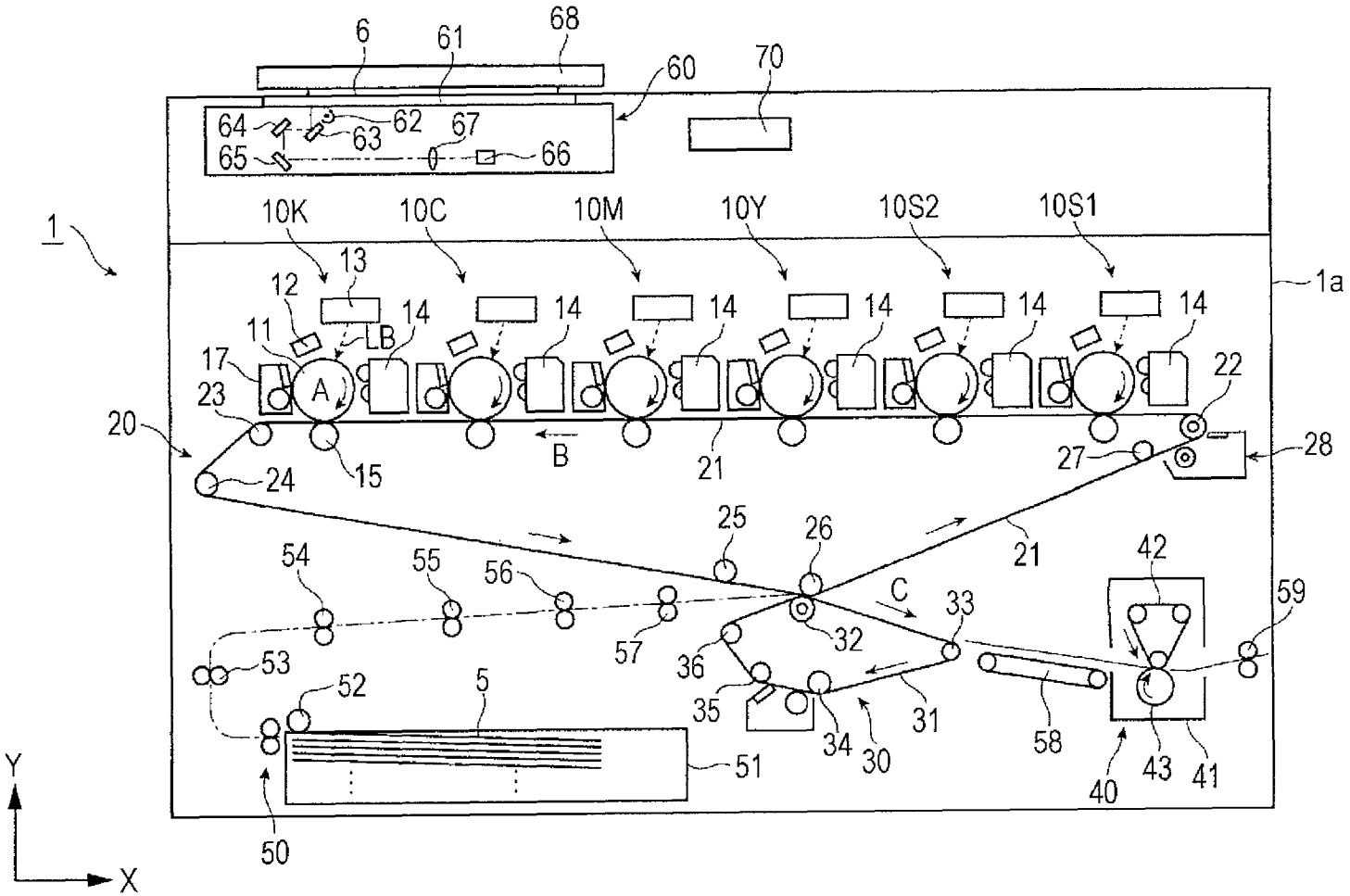
FIG. 1 illustrates a configuration of an image forming apparatus according to a first exemplary embodiment of the present invention.

Referring now to the drawings, exemplary embodiments of the present invention will be described below.

First Exemplary Embodiment

Figure 2:
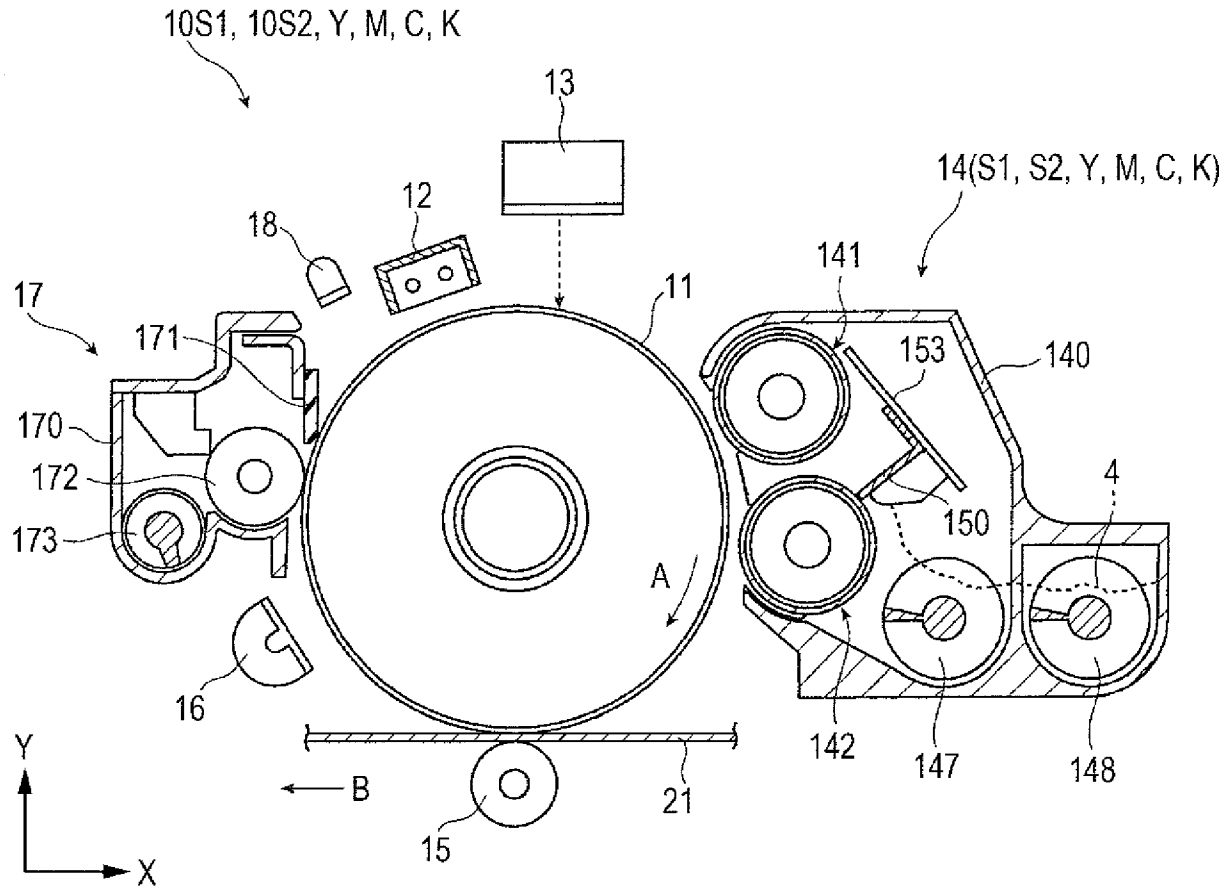
FIG. 2 illustrates a configuration of a related portion of the image forming apparatus according to the first exemplary embodiment of the invention.

FIGS. 1 and 2 illustrate an image forming apparatus 1 including a developing device according to a first exemplary embodiment. FIG. 1 roughly illustrates the entirety of the image forming apparatus 1 while FIG. 2 illustrates a related portion (including an image forming device or the like) of the image forming apparatus 1 in an enlarged manner.

Configuration of Entirety of Image Forming Apparatus

The image forming apparatus 1 according to the first exemplary embodiment is, for example, a color printer. The image forming apparatus 1 includes multiple image forming devices 10, an intermediate transfer device 20, a sheet supply device 50, and a fixing device 40. The image forming devices 10 each form a toner image by developing a latent image with a toner included in a developer 4. The intermediate transfer device 20 holds the toner images formed by the image forming devices 10 and transports the toner images to a second transfer position at which the toner images are finally second-transferred to a recording sheet 5, which is an example of a recording medium. The sheet supply device 50 contains predetermined recording sheets 5 that are to be fed to the second transfer position of the intermediate transfer device 20 and transports the recording sheets 5 to the second transfer position. The fixing device 40 fixes the toner images that have been second transferred to a recording sheet 5 by the intermediate transfer device 20 to the recording sheet 5.

When, for example, the image forming apparatus 1 additionally includes an image input device 60 through which a document image that is to be formed on a recording sheet 5 is input, the image forming apparatus 1 is capable of functioning as a color copying machine. A housing 1*a* of the image forming apparatus 1 illustrated in FIG. 1 includes a support structure member and an exterior cover. The dot-and-dash line of FIG. 1 indicates a rough transport path along which the recording sheet 5 is transported in the housing 1*a*.

The image forming devices 10 are six image forming devices 10Y, 10M, 10C, 10K, 10S1, and 10S2, which individually form toner images of yellow (Y), magenta (M), cyan (C), black (K), a spot color (S1), and another spot color (S2). Here, yellow (Y), magenta (M), cyan (C), and black (K) are four standard colors. The six image forming devices 10 (10S1, 10S2, 10Y, 10M, 10C, and 10K) are arranged in a nearly straight line inside the housing 1*a*. Examples of the developers 4 of the spot colors S1 and S2 include materials having colors that are not or hardly be expressed with the four standard colors. Specifically, examples of the developers 4 of the spot colors S1 and S2 include toners having colors other than the four standard colors, toners having the same colors as the four standard colors but different chroma, a transparent toner for improving a gloss, a foam toner for Braille, and toners having fluorescent colors. As described below, the image forming devices 10 (10S1, 10S2, 10Y, 10M, 10C, and 10K) have substantially the same configuration, except that they use different types of developers.

As illustrated in FIGS. 1 and 2, the image forming devices 10 (10S1, 10S2, 10Y, 10M, 10C, and 10K) each include a photoconductor drum 11, which is an example of an image holding member that rotates. Following devices are arranged around each photoconductor drum 11: a charging device 12 that charges a circumferential surface (image holding surface) of the photoconductor drum 11, on which an image is formable, to a predetermined potential; an exposure device 13 that irradiates the charged circumferential surface of the photoconductor drum 11 with a light beam LB based on image information (signal) to form an electrostatic latent image (for a corresponding color) having a potential difference on the surface; a developing device 14 (corresponding to S1, S2, Y, M, C, or K), which serves as a developing unit that develops the electrostatic latent image with a toner of a developer 4 having the corresponding color (S1, S2, Y, M, C, or K) to form a toner image; a first transfer device 15 that transfers the toner image to the intermediate transfer device 20; a pre-cleaning charging device 16 that charges remnants including a toner that remain on and adhere to the image holding surface of the photoconductor drum 11 after first transfer; a drum cleaning device 17 that removes the recharged remnants to clean the image holding surface; and a static eliminator 18 that eliminates the remaining charge from the image holding surface after cleaning of the photoconductor drum 11.

The photoconductor drum 11 has a cylindrical base member having an image holding surface at the circumferential surface of the cylindrical base member. The cylindrical base member is grounded. The image holding surface has a photoconductive layer (photosensitive layer) made of a photosensitive material. The photoconductor drum 11 is supported so as to be rotatable in a direction indicated by the arrow A in FIG. 1 with power being transmitted thereto from a rotational driving device, not illustrated.

A contactless charging device, such as a corona discharging device, disposed without contacting the photoconductor drum 11 is used as an example of the charging device 12. A charging voltage is supplied to a charging device in the charging device 12. In the case where the developing device 14 performs reversal development, the charging voltage that the charging device 12 supplies is a voltage or current having the same polarity as the polarity to which the toner supplied from the developing device 14 is charged.

The exposure device 13 irradiates the charged circumferential surface of the photoconductor drum 11 with light (indicated by the dotted arrow) LB formed on the basis of image information input to the image forming apparatus 1 so as to form an electrostatic latent image. When an electrostatic latent image is to be formed, image information (signal) input to the image forming apparatus 1 via any appropriate way is transmitted to the exposure device 13.

The first transfer device 15 is a contact transfer device that rotates while contacting the circumferential surface of the photoconductor drum 11 and that includes a first transfer roller to which a first transfer voltage is applied. A DC voltage that has the polarity opposite to the polarity to which the toner is charged is supplied as the first transfer voltage from a power source, not illustrated.

As illustrated in FIG. 2, the drum cleaning device 17 includes a body 170 having a partially open container shape, a cleaning blade 171, a rotary brush roller 172, and a transmitting member 173. The cleaning blade 171 is disposed so as to be pressed with a predetermined pressure against a portion of the circumferential surface of the photoconductor drum 11 that has undergone first transfer. The cleaning blade 171 thus removes remaining remnants, such as a toner, and cleans the circumferential surface of the photoconductor drum 11. The rotary brush roller 172 is disposed upstream from the cleaning blade 171 in the direction of rotation of the photoconductor drum 11 so as to rotate while contacting the circumferential surface of the photoconductor drum 11. The transmitting member 173 is a component such as a screw auger that collects the remnants such as a toner removed by the cleaning blade 171 and transports the remnants to a recovery system, not illustrated. A plate member (for example, a blade) made of a material such as rubber is used as the cleaning blade 171.

As illustrated in FIG. 1, the intermediate transfer device 20 is disposed below the image forming devices 10 (10S1, 10S2, 10Y, 10M, 10C, and 10K). The intermediate transfer device 20 includes an intermediate transfer belt 21, multiple belt supporting rollers 22 to 27, and a belt cleaning device 28. The intermediate transfer belt 21 rotates in the direction of arrow B while passing first transfer positions that are between the photoconductor drum 11 and the first transfer devices 15 (the first transfer rollers). The belt supporting rollers 22 to 27 rotatably support the intermediate transfer belt 21 from the inner side of the intermediate transfer belt 21 so as to hold the intermediate transfer belt 21 in a desired state. The belt cleaning device 28 removes remnants such as a toner or paper dust adhering to a portion of the outer peripheral surface of the intermediate transfer belt 21 that has been passed the second transfer device 30 and cleans the intermediate transfer belt 21.

As an example of the intermediate transfer belt 21, an endless belt made of a material obtained by dispersing a resistance adjustment substance, such as carbon black, in a synthetic resin, such as a polyimide resin or polyamide resin, is used. The belt supporting roller 22 is a driving roller, while the belt supporting rollers 23, 25, and 27, are driven rollers used to keep the intermediate transfer belt 21 in a traveling position or other conditions. The belt supporting roller 24 functions as a tension roller. The belt supporting roller 26 functions as a backup roller for second transfer.

A second transfer device 30 is disposed on the outer peripheral surface (image holding surface) side of the intermediate transfer belt 21 at a position at which the intermediate transfer belt 21 is supported by the belt supporting roller 26. The second transfer device 30 second transfers toner images formed on the intermediate transfer belt 21 to a recording sheet 5. As illustrated in FIG. 1, the second transfer device 30 includes a second transfer belt 31 and multiple support rollers 32 to 36. The second transfer belt 31 rotates in the direction of arrow C while passing a second transfer position, at which a portion of the outer peripheral surface of the intermediate transfer belt 21 is supported by the belt supporting roller 26 of the intermediate transfer device 20. The support rollers 32 to 36 rotatably support the second transfer belt 31 from the inner side of the second transfer belt 31 so as to maintain the second transfer belt 31 in a desired state. As an example of the second transfer belt 31, an endless belt manufactured in substantially the same manner as the intermediate transfer belt 21 is used. The belt supporting roller 32 is disposed so as to press the second transfer belt 31 with a predetermined pressure against a portion of the outer peripheral surface of the intermediate transfer belt 21 supported by the belt supporting roller 26. The belt supporting roller 32 is a driving roller while the belt supporting roller 36 functions as a tension roller. A DC voltage having a polarity that is opposite to or the same as the polarity to which a toner is charged is applied to the belt supporting roller 32 of the second transfer device 30 or to the support roller 26 of the intermediate transfer device 20 as a second transfer voltage.

The fixing device 40 includes a housing 41, a heating rotor 42, and a pressure applying rotor 43. The housing 41 has an insertion opening and an ejection opening through which a recording sheet 5 is inserted and ejected. The heating rotor 42 and the pressure applying rotor 43 are disposed inside the housing 41. The heating rotor 42 rotates in the direction of the arrow illustrated in FIG. 1 and includes a fixing belt that is heated by a heating unit so that the surface temperature is maintained at a predetermined temperature. The pressure applying rotor 43 is shaped like a drum and is driven to rotate while being pressed against the heating rotor 42 with a predetermined pressure and extending in substantially the axial direction of the heating rotor 42. In the fixing device 40, a portion at which the heating rotor 42 and the pressure applying rotor 43 contact each other serves as a fixing portion at which a predetermined fixing operation (application of heat and pressure) is performed.

The sheet supply device 50 is disposed below the intermediate transfer device 20 and the second transfer device 30. The sheet supply device 50 includes one sheet container 51 (or more) and a feeding device 52. The sheet container 51 contains recording sheets 5 of a predetermined size or type in a stacked manner. The feeding device 52 feeds the recording sheets 5 one by one from the sheet container 51. The sheet container 51 is attached to the housing 1*a* so as to be drawn to, for example, the front of the housing 1*a* (to the side that a user faces during operation). Examples of the recording sheets 5 fed from the sheet supply device 50 include, in addition to plain paper and thick paper, a recording sheet having projections and depressions on its surface such as an embossed sheet.

The image forming apparatus 1 is appropriately switchable between a plain paper mode, in which the image forming apparatus 1 forms an image on plain paper, and an embossed paper mode, in which the image forming apparatus 1 forms an image on a recording sheet having projections and depressions on its surface such as embossed paper.

A sheet-feeding transport path extends between the sheet supply device 50 and the second transfer device 30. The sheet-feeding transport path includes multiple pairs of sheet transport rollers 53 to 57 and a transport guide member, not illustrated. The multiple pairs of sheet transport rollers 53 to 57 transport the recording sheet 5 fed by the sheet supply device 50 toward the second transfer position. The pair of sheet transport rollers 57, disposed at a position immediately preceding the second transfer position in the sheet-feeding transport path, function as, for example, rollers (registration rollers) that adjust the timing at which the recording sheet 5 is transported. In addition, a sheet transporting device 58 is disposed between the second transfer device 30 and the fixing device 40. The sheet transporting device 58 is in the form of, for example, a belt and transports a recording sheet 5 that has been fed from the second transfer belt 31 of the second transfer device 30 after undergoing second transfer to the fixing device 40. Furthermore, a pair of sheet ejecting rollers 59 are disposed near a sheet ejection opening formed in the housing 1*a*. The pair of sheet ejecting rollers 59 eject a recording sheet 5 that has been fed from the fixing device 40 after undergoing a fixing operation to the outside of the housing 1*a*.

The above-described image input device 60, which is included in the image forming apparatus 1 when the image forming apparatus 1 functions as a color copying machine, is an image reading device that reads an image of a document having image information that is to be printed. As illustrated in FIG. 1, the image input device 60 is disposed, for example, at a top portion of the housing 1*a*. The image input device 60 includes a document receivable plate (platen glass) 61, a light source 62, a reflecting mirror 63, a first reflecting mirror 64, a second reflecting mirror 65, an image reading device 66 such as a charge coupled device (CCD), an imaging lens 67, and a cover 68 that covers the document receivable plate 61. The document receivable plate 61 is a plate made of, for example, a transparent glass plate on which a document 6 having image information that is to be read is placed. The light source 62 illuminates the document 6 placed on the document receivable plate 61 while moving. The reflecting mirror 63 receives light reflected from the document 6 and reflects the reflected light in a predetermined direction while moving together with the light source 62. The first reflecting mirror 64 and the second reflecting mirror 65 move a predetermined distance at a predetermined speed relative to the reflecting mirror 63. The image reading device 66 receives and reads the reflected light from the document 6 and converts the reflected light into an electric signal. The imaging lens 67 images the reflected light on the image reading device 66.

Image information of a document read by and input to the image input device 60 is subjected to appropriate image processing by an image processing device 70. First, the image input device 60 transmits the read document image information to the image processing device 70 as image data (for example, 8-bit data) of three colors of red (R), green (G), and blue (B). The image processing device 70 performs predetermined image processing on image data transmitted from the image input device 60, such as shading correction, misregistration correction, lightness/color space conversion, gamma correction, frame erasure, or color/movement edition. The image processing device 70 converts signals of the image that has been image-processed into image signals of the above-described four standard colors of Y, M, C, and K and then transmits the image signals to the exposure devices 13. The image processing device 70 also generates image signals of the above-described two spot colors S1 and S2.

Basic Operation of Image Forming Apparatus

Now, a basic image forming operation performed by the image forming apparatus 1 is described below.

First, a description is given of an image forming operation performed when a full-color image is formed by using the four image forming devices 10 (10Y, 10M, 10C, and 10K) and by combining toner images of the four standard colors of Y, M, C, and K.

When the image forming apparatus 1 receives a command to start an image forming operation (printing), the four image forming devices 10 (10Y, 10M, 10C, and 10K), the intermediate transfer device 20, the second transfer device 30, the fixing device 40, and other related devices are actuated.

In each image forming device 10 (10Y, 10M, 10C, or 10K), firstly, the photoconductor drum 11 rotates in the direction of arrow A and the charging device 12 charges the surface of the photoconductor drum 11 to a predetermined polarity (negative polarity in the first exemplary embodiment) and to a predetermined potential. Subsequently, the exposure device 13 irradiates the charged surface of the photoconductor drum 11 with a light beam LB. Here, the light beam LB is emitted based on an image signal obtained by converting image information input to the image forming apparatus 1 into a corresponding color component (of the color of Y, M, C, or K). Thus, an electrostatic latent image for the corresponding color component is formed on the surface of the photoconductor drum 11 by using a predetermined potential difference.

Then, each developing device 14 (corresponding to Y, M, C, or K) develops the electrostatic latent image of the corresponding color formed on the corresponding photoconductor drum 11 by electrostatically attaching a toner of the corresponding color of Y, M, C, or K that has been charged to a predetermined polarity (negative polarity) to the electrostatic latent image. With this development with the toner of the corresponding one of the four standard colors of Y, M, C, and K, the electrostatic latent image of the corresponding color formed on the photoconductor drum 11 is rendered visible as a toner image of the corresponding color.

Subsequently, the toner images of the four standard colors of Y, M, C, and K formed on the photoconductor drums 11 of the image forming devices 10 (10Y, 10M, 10C, and 10K) are transported to the corresponding first transfer positions. Then, the first transfer devices 15 first transfer the toner images of the four standard colors such that the toner images are sequentially superposed on the intermediate transfer belt 21 of the intermediate transfer device 20 that rotates in the direction of arrow B.

After the first transfer is finished, in each image forming device 10, the pre-cleaning charging device 16 recharges the remnants such as a toner remaining on the surface of the photoconductor drum 11 that has undergone the first transfer. Then, the drum cleaning device 17 scrapes the recharged remnants off the surface of the photoconductor drum 11 to clean the surface of the photoconductor drum 11. Finally, the static eliminator 18 eliminates static on the cleaned surface of the photoconductor drum 11. Consequently, each image forming device 10 is restored ready for a subsequent image forming operation.

Subsequently, the intermediate transfer device 20 carries the first-transferred toner images to the second transfer position by using rotation of the intermediate transfer belt 21. The sheet supply device 50, meanwhile, feeds a predetermined recording sheet 5 to the sheet-feeding transport path in accordance with the image forming operation. In the sheet-feeding transport path, the pair of sheet transport rollers 57, serving as registration rollers, feed the recording sheet 5 to the second transfer position at appropriate timing for transfer.

At the second transfer position, the second transfer device 30 collectively second transfers the toner images on the intermediate transfer belt 21 to the recording sheet 5. After second transfer is finished, in the intermediate transfer device 20, the belt cleaning device 28 removes remnants such as a toner remaining on the surface of the intermediate transfer belt 21 that has undergone the second transfer to clean the surface of the intermediate transfer belt 21.

Subsequently, the recording sheet 5 to which the toner images have been second transferred is separated from the intermediate transfer belt 21 and the second transfer belt 31 and then transported to the fixing device 40 by the sheet transporting device 58. At the fixing device 40, the second-transferred recording sheet 5 is inserted into and caused to pass through a contact portion between the rotating heating rotor 42 and the rotating pressure applying rotor 43 so that the toner images that have not been fixed to the recording sheet 5 are fixed to the recording sheet 5 by undergoing an appropriate fixing operation (application of heat and pressure). In the case where the image forming operation is performed to form an image on a single side of the recording sheet 5, the recording sheet 5 that has undergone the fixing operation is finally ejected by the pair of sheet ejecting rollers 59 toward, for example, an ejected-sheet container, not illustrated, disposed outside the housing 100.

With the above operation, the recording sheet 5 on which a full-color image is formed by combining toner images of four colors is output.

Now, a description is given of the case where the image forming apparatus 1 performs the above-described normal image forming operation and also an operation of forming spot color toner images using developers of the spot colors S1 and S2.

In this case, firstly, the image forming devices 10S1 and 10S2 perform an image forming operation that is similar to the operation performed by the image forming devices 10 (10Y, 10M, 10C, and 10K). Thus, toner images of spot colors S1 and S2 are formed on the photoconductor drums 11 of the image forming devices 10S1 and 10S2. Subsequently, as in the case of the image forming operation of the toner images of the four standard colors, the spot color toner images formed by the image forming devices 10S1 and 10S2 are first transferred to the intermediate transfer belt 21 of the intermediate transfer device 20 and then second transferred (together with the toner images of the four standard colors) to the recording sheet 5 from the intermediate transfer belt 21 by the second transfer device 30. Finally, the recording sheet 5 to which the toner images of the spot colors and the four standard colors have been second transferred is subjected to a fixing operation by the fixing device 40 and ejected to the outside of the housing 1*a*.

With the above operation, the recording sheet 5 on which the two spot color toner images are superposed on the entirety or part of the full-color image formed by combining the toner images of four colors is output.

In the case where the image forming apparatus 1 is a color copying machine including the image input device 60, a basic image forming operation is performed in the following manner.

When a document 6 is set on the image input device 60 and the image input device 60 receives a command to start an image forming operation (copying), the image input device 60 reads a document image of the document 6. Then, the image processing device 70 performs the above-described image processing on information of the read document image and generates image signals. Thereafter, the image signals are transmitted to the exposure devices 13 of the image forming devices 10 (10S1, 10S2, 10Y, 10M, 10C, and 10K). Thus, each image forming device 10 forms an electrostatic latent image on the basis of the image information of the document 6 and forms a toner image. Each image forming device 10 then operates similarly as in the case of the above-described image forming operation (printing). Finally, an image formed of the toner images is formed on the recording sheet 5 and the recording sheet 5 is output.

Here, the image forming apparatus 1 may directly transfer the toner images formed by the image forming devices 10 (10S1, 10S2, 10Y, 10M, 10C, and 10K) to the recording sheet 5 without using the intermediate transfer belt 21 of the intermediate transfer device 20.

Configuration of Developing Device

Figure 3:
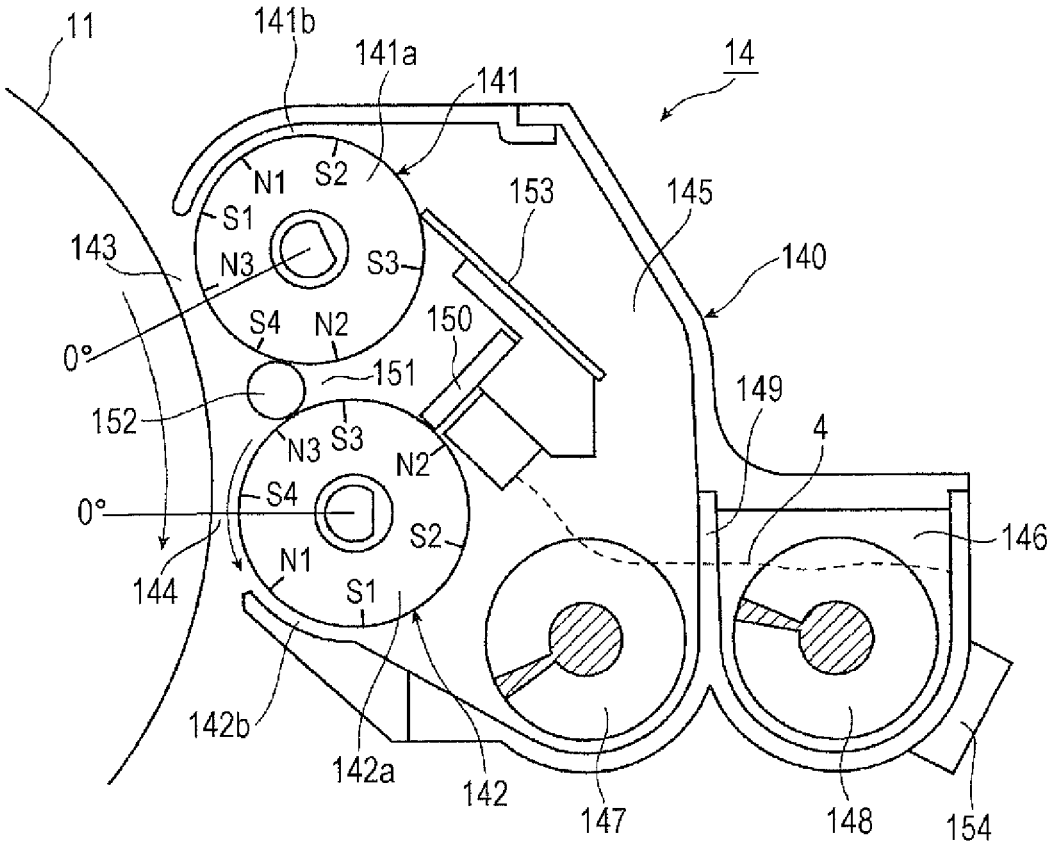
FIG. 3 illustrates a configuration of a developing device according to the first exemplary embodiment of the invention.

FIG. 3 is a cross sectional view of the developing device 14 mounted on the image forming apparatus 1 according to the first exemplary embodiment.

As illustrated in FIG. 3, the developing device 14 is disposed at a development region so as to face the photoconductor drum 11. The developing device 14 includes a developing device body 140 containing a two-component developer 4 including a toner and a carrier. The developing device body 140 includes a first development roller 141, which serves as a first developer holder, and a second development roller 142, which serves as a second developer holder. The first development roller 141 is disposed upstream from the second development roller 142 in the direction of rotation of the photoconductor drum 11. The first and second development rollers 141 and 142 are disposed adjacent to each other so as to face the surface of the photoconductor drum 11.

The first development roller 141 includes a first magnetic roller 141*a* and a first development sleeve 141*b*. The first magnetic roller 141*a* is stationarily disposed at the inner side of the first development roller 141 and the first development sleeve 141*b* is disposed on the outer circumference of the first magnetic roller 141*a*. The second development roller 142 includes a second magnetic roller 142*a* and a second development sleeve 142*b*. The second magnetic roller 142*a* is stationarily disposed at the inner side of the second development roller 142 and the second development sleeve 142*b* is disposed on the outer circumference of the second magnetic roller 142*a*.

Figure 4:
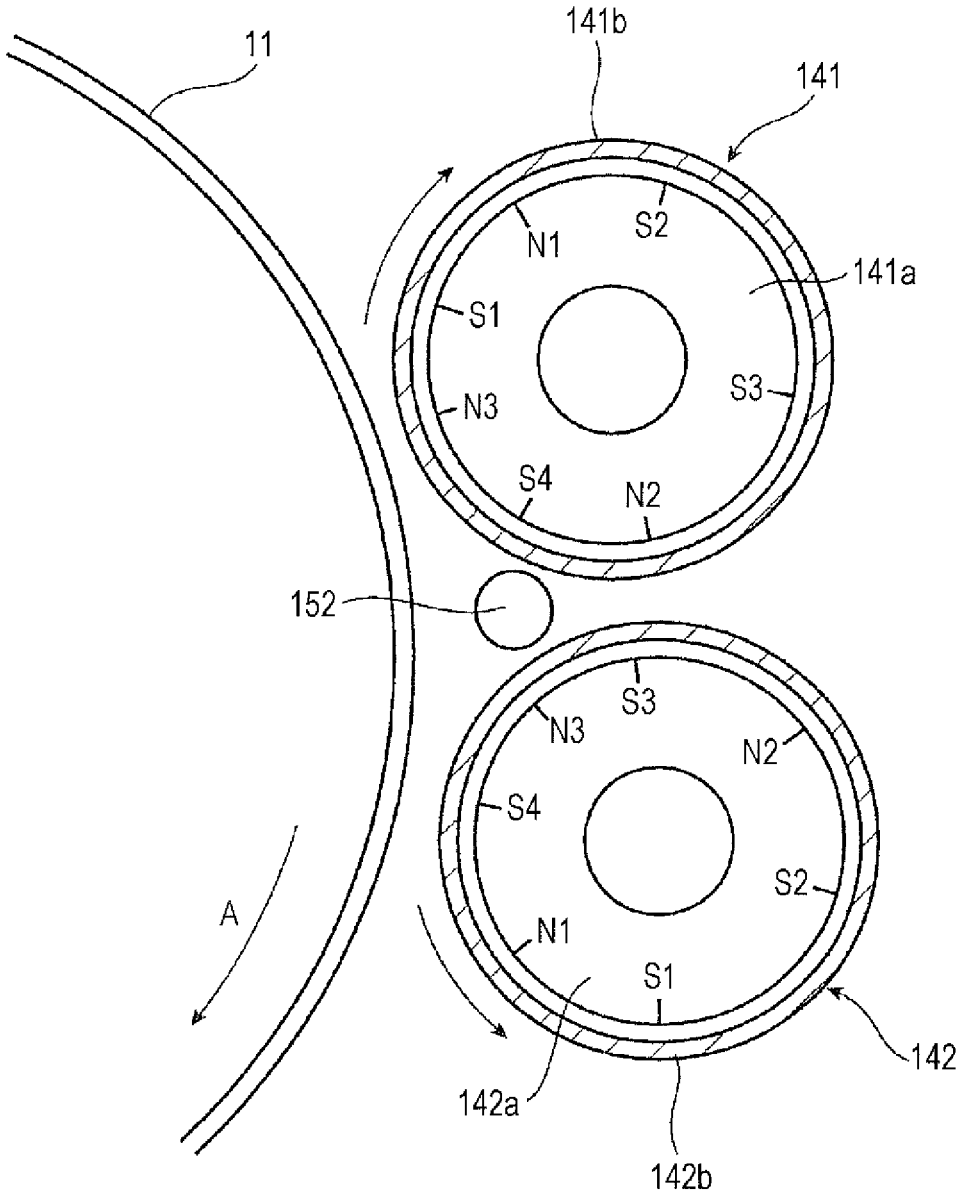
FIG. 4 illustrates a configuration of the developing device according to the first exemplary embodiment of the invention.

As illustrated in FIGS. 3 and 4, the first and second development sleeves 141*b* and 142*b* are cylindrical members and made of a nonmagnetic material such as aluminum or nonmagnetic stainless steel. The first and second development sleeves 141*b* and 142*b* are attached to the developing device body 140 so as to be rotatable. The first development sleeve

141*b* is driven to rotate in the same direction as the direction of rotation of the photoconductor drum 11 (direction of the arrow illustrated in FIG. 3). Thus, the first development sleeve 141*b* rotates so as to move in the direction opposite to the direction of movement of the surface of the photoconductor drum 11 at a facing portion 143 (first development region), at which the first development sleeve 141*b* faces the photoconductor drum 11, and so that the peripheral velocity ratio of the first development sleeve 141*b* to the photoconductor drum 11 is kept at a predetermined peripheral velocity ratio. The first development sleeve 141*b* is disposed such that the shortest distance (hereinafter also referred to as "DRS") between the first development sleeve 141*b* and the photoconductor drum 11 is kept at a predetermined distance.

The second development sleeve 142*b*, on the other hand, is driven to rotate in the direction opposite to the direction of rotation of the photoconductor drum 11 (the direction of the arrow illustrated in FIG. 3). Thus, the second development sleeve 142*b* rotates so as to move in the direction the same as the direction of movement of the surface of the photoconductor drum 11 at a facing portion 144 (second development region), at which the second development sleeve 142*b* faces the photoconductor drum 11, and so that the peripheral velocity ratio of the second development sleeve 142*b* to the photoconductor drum 11 is kept at a predetermined peripheral velocity ratio. The second development sleeve 142*b* is disposed such that the shortest distance (DRS) between the first development sleeve 141*b* and the photoconductor drum 11 is kept at a predetermined distance.

As illustrated in FIGS. 3 and 4, the first magnetic roller 141*a* has a third north pole (N3), serving as a development pole, at the first development region 143 at which the first magnetic roller 141*a* faces and is close to the photoconductor drum 11. The first magnetic roller 141*a* is magnetized to sequentially have a first south pole S1, a first north pole N1, and a second south pole S2, which serve as transportation poles for transporting the developer 4, downstream from the third north pole N3 in the direction of rotation of the development sleeve 141*b*. The first magnetic roller 141*a* is magnetized so as to have a third south pole S3 downstream from the second south pole S2. The second south pole S2 and the third south pole S3 serve as removal poles that remove the developer 4 from the surface of the development sleeve 141*b*. The first magnetic roller 141*a* is also magnetized to have a second north pole N2 downstream from the third south pole S3 in the direction of rotation of the development sleeve 141*b* at a position at which the first development roller 141 faces the second development roller 142. The second north pole N2 serves as a dividing pole at which the developer 4 is divided between the first development roller 141 and the second development roller 142. The first magnetic roller 141*a* also has a fourth south pole S4, serving as a transportation pole, between the second north pole N2 and the third north pole N3 serving as a development pole.

As illustrated in FIG. 3, these poles are positioned along the circumference of the magnetic roller 141*a* at predetermined angles with respect to the reference position (from the zero angle) positioned a certain distance upstream from the third north pole N3, serving as a development pole, in the direction of rotation of the development sleeve 141*b*. Each pole has a predetermined magnetic flux density.

As illustrated in FIG. 3, the second magnetic roller 142*a*, on the other hand, has a fourth south pole S4, serving as a development pole, at a second development region 144 at which the second magnetic roller 142*a* faces and is close to the photoconductor drum 11. The second magnetic roller 142*a* is magnetized to have a first north pole N1 and a first south pole S1, serving as transportation poles for transporting the developer 4, downstream from the fourth south pole S4 in the direction of rotation of the development sleeve 142*b*. The second magnetic roller 142*a* is magnetized to have a second south pole S2 downstream from the first south pole S1. The first south pole S1 and the second south pole S2 serve as removal poles that remove the developer 4 from the surface of the development sleeve 142*b*. The second magnetic roller 142*a* is also magnetized to have a second north pole N2, serving as a transportation pole for transporting the developer 4, downstream from the second south pole S2 in the direction of rotation of the development sleeve 142*b*. The second magnetic roller 142*a* is also magnetized to have a third south pole S3 downstream from the second north pole N2 and at a position at which the second magnetic roller 142*a* faces the first development roller 141. The third south pole S3 has a polarity opposite to the polarity of the second north pole N2 of the first magnetic roller 141*a* and serves as a dividing pole that divides the developer 4 between the first development roller 141 and the second magnetic roller 142. The second magnetic roller 142 also has a third north pole N3, serving as a transportation pole, between the third south pole S3 and the fourth south pole S4 serving as a development pole.

As illustrated in FIG. 3, these poles are positioned along the circumference of the magnetic roller 142*a* at predetermined angles with respect to the reference position (from the zero angle) positioned a certain distance downstream from the fourth south pole S4, serving as a development pole, in the direction of rotation of the development sleeve 142*b*. Each pole has a predetermined magnetic flux density.

In the first exemplary embodiment, the case where seven poles are arranged along the circumference of each of the first and second magnetic rollers 141*a* and 142*a* is described. However, the number of poles arranged along the circumference of each magnetic roller 141*a* or 142*a* is not limited to seven and may be five, for example.

The developing device body 140 includes a first agitating chamber 145 and a second agitating chamber 146. The first agitating chamber 145 is disposed at the rear side of the second development roller 142. The first agitating chamber 145 contains the developer 4 and the developer 4 is agitated therein. The second agitating chamber 146 is adjacent to the first agitating chamber 145. The developing device body 140 includes, in the first agitating chamber 145, a first agitating member 147 that transports the developer 4 while agitating the developer 4. The developing device body 140 includes, in the second agitating chamber 146, a second agitating member 148 that transports the developer 4 while agitating the developer 4. The first agitating member 147 and the second agitating member 148 transport the developer 4 in opposite directions. Each of the first and second agitating members 147 and 148 includes a rotation shaft and a transportation vane helically attached to the outer circumference of the rotation shaft. The first and second agitating members 147 and 148 are mounted on the developing device body 140 so as to be rotatable.

The first agitating chamber 145 and the second agitating chamber 146 are separated by a partition member 149. The partition member 149 has openings at both end portions in the longitudinal direction of the partition member 149 to connect the first agitating chamber 145 and the second agitating chamber 146 together. The developer 4 contained in the first and second agitating chambers 145 and 146 is transported by the first and second agitating members 147 and 148 so as to circulate throughout the first and agitating chambers 145 and 146 via the openings.

At an upstream end portion of the second agitating member 148 in the direction of transporting the developer, a developer replenishing device, not illustrated, is provided that replenishes the second agitating chamber 146 with a new lot of developer 4 including at least a toner.

The developer 4 contained in the developing device body 140 is a two-component developer including a toner and a carrier. The toner includes toner particles and external additives whose mean volume particle diameter is in a range from 50 nm to 400 nm, inclusive. The toner particles include, for example, a binder resin, a coloring agent, and, if needed, other additives such as a release agent.

The properties of the toner particles are described now. Preferably, the toner particles have a mean shape factor in a range from 100 to 150. The mean shape factor is the mean of shape factors calculated by $(ML^2/A)\times(\pi/4)\times100$, where ML denotes the maximum length of a particle and A denotes the projected area of the particle. More preferably, the toner particles have a mean shape factor in a range from 105 to 145, or most preferably, 110 to 140.

Preferably, the toner particles have a mean volume particle diameter (D50) in a range from 2.0 μm to 6.5 μm, inclusive, or more preferably 2.0 μm to 6.0 μm, inclusive. When the mean volume particle diameter (D50) of the toner particles falls within the above range, a streak-like background fog is prevented from occurring. Reduction of the particle diameter of toner particles leads to improvement of graininess of an image (image quality). On the other hand, if the particle diameter falls below 2.0 μm, the electric charge per toner particle becomes too small, thereby causing a background fog or transfer failure.

Preferably, the mean volume particle diameter of the additive falls within the range from 50 nm to 400 nm, more preferably, 60 nm to 300 nm, and further preferably, 80 nm to 200 nm. If the mean volume particle diameter of the additive falls below 50 nm, the additive is highly likely to adhere to a toner particle and to be buried in the toner particle. Thus, the toner particle is less likely to be removed from an electrophotographic photoconductor. On the other hand, if the particle diameter of the additive exceeds 400 nm, the additive is less likely to adhere to a toner particle and more likely to come off the toner particle. Thus, the effect of the additive is less likely to be sustained.

Examples of a carrier of the two-component developer includes a coated ferrite core having a specific gravity exactly or approximately in a range between 2 to $7\times10^3$ kg/m$^3$ and a mean volume particle diameter exactly or approximately in a range between 10 to 40 μm. Here, the toner density falls within a range, for example, between 5 to 15%.

A thickness regulating member 150 is also disposed inside the developing device body 140. The thickness regulating member 150 regulates the thickness of a layer of the developer 4 supplied by the first agitating member 147 to the surface of the second development roller 142. The thickness regulating member 150 is made of, for example, a nonmagnetic-metal flat plate. The thickness regulating member 150 is disposed downstream from the second north pole N2 of the second magnetic roller 142*a* in the direction of rotation of the second development sleeve 142*b* so as to face the surface of the second development sleeve 142*a* with a predetermined gap therebetween. The thickness regulating member 150 regulates the amount of developer 4 that has been supplied to the surface of the first development roller 141.

A flattening member 152 is disposed downstream from a facing portion 151 at which the first development roller 141 and the second development roller 142 face each other. The flattening member 152 flattens the surfaces of layers of the developer 4 divided between the first development roller 141 and the second development roller 142. The flattening member 152 has a cylindrical shape or a shape having a triangular cross section. The flattening member 152 is disposed so as to face the surfaces of the first development roller 141 and the second development roller 142 with gaps interposed therebetween.

As illustrated in FIG. 3, a guide member 153 is also disposed inside the developing device body 140. The guide member 153 guides the developer 4 that has been removed from the surface of the first development roller 141 by the second and third south poles S2 and S3, serving as removal poles, toward the first agitating member 147. The guide member 153 is a plate-like member made of, for example, a nonmagnetic metal, such as aluminum or a nonmagnetic stainless steel, a synthetic resin, or a composite material of a nonmagnetic metal and a synthetic resin. At least a surface of a portion of the guide member 153 that contacts the developer 4 is made of a nonmagnetic plate. The guide member 153 is disposed such that its one end portion is positioned over the surface of the first development roller 141 with a gap therebetween and between the second and third south poles S2 and S3, serving as removal poles, and such that a middle portion that is continuous with the one end portion and that is formed into a flat plate is inclined with respect to the horizontal direction. A rear end portion of the guide member 153 is positioned above the first agitating member 147.

As illustrated in FIG. 3, the developing device body 140 also includes a toner density sensor 154, which detects the density of toner in the developer 4, at a side wall of the second agitating chamber 146.

Operation of Developing Device

Now, an operation of the developing device 14 according to the exemplary embodiment is described.

As illustrated in FIG. 3, when the image forming operation is started, the first and second development rollers 141 and 142 and the first and second agitating members 147 and 148 are driven to rotate in the developing device 14. Here, while the developer 4 contained in the first and second agitating chambers 145 and 146 is agitated and transported, the toner in the developer 4 is charged to a negative polarity by being rubbed with the carrier. Concurrently, the first agitating member 147 supplies the developer 4 to the surface of the second development roller 142.

The developer 4 supplied to the surface of the second development roller 142 is transported counterclockwise as the second development sleeve 142*b* rotates while the thickness of a layer of the developer 4 is regulated by the thickness regulating member 150. Thereafter, at the facing portion 151 at which the first development roller 141 and the second development roller 142 face each other, the developer 4 is divided between the first development roller 141 and the second development roller 142 by the second north pole N2 of the first magnetic roller 141*a* and the third south pole S3 of the second magnetic roller 142*a*, which serve as dividing poles. At this time, the proportions of the developer 4 divided between the first development roller 141 and the second development roller 142 are changeable by changing the widths of the second north pole N2 and third south pole S3, serving as dividing poles, or the magnitudes of the magnetic force of the poles N2 and S3. The developer 4 allotted to the first development roller 141 is transported clockwise as the development sleeve 141*b* rotates. After the surface of a layer of the developer 4 is flattened by the flattening member 152, the developer 4 arrives the first development region 143 at which the developer 4 faces the surface of the photoconductor drum 11. Here, an electrostatic latent image formed on the surface of the photoconductor drum 11 is developed by the third north pole N3, serving as the development pole, with the developer 4 that is in a form of a magnetic brush by the toner adhering to the carrier. The developer 4 held on the surface of the first development roller 141 is transported clockwise as the first development sleeve 141*b* rotates further and then removed from the surface of the development sleeve 141*b* by the second south pole S2 and third south pole S3, serving as removal poles that form a repulsive magnetic field. Thereafter, a new lot of developer 4 is supplied to the surface of the first development roller 141 by the second development roller 142.

On the other hand, the developer 4 allotted to the second development roller 142 is transported counterclockwise as the second development sleeve 142*b* rotates. After the surface of a layer of the developer 4 is flattened by the flattening member 152, the developer 4 arrives the second development region 144 at which the developer 4 faces the surface of the photoconductor drum 11. Here, an electrostatic latent image formed on the surface of the photoconductor drum 11 is developed by the fourth south pole S4, serving as a development pole, with the developer 4 that is in the form of a magnetic brush. The developer 4 held on the surface of the second development roller 142 is transported counterclockwise as the second development sleeve 142*b* rotates further and then removed from the surface of the development sleeve 142*b* by the first south poles S1 and second south pole S2, serving as removal poles that form a repulsive magnetic field. Thereafter, a new lot of developer 4 is supplied to the surface of the development sleeve 142*b* by the first agitating member 147.

As illustrated in FIG. 3, the developer 4 that has been removed from the surface of the first development roller 141 is guided along the surface of the guide member 153 and falls on an upper portion of the first agitating member 147. Then, the removed developer 4 is mixed with the developer 4 contained in the first agitating chamber 145, transported by the first agitating member 147, and fed to the second development roller 142. Here, the direction of rotation of the first agitating member 147 is opposite to the direction of rotation of the second development roller 142 (the first agitating member 147 rotates clockwise in FIG. 3). Thus, the developer 4 removed from the surface of the second development roller 142 is not immediately fed to the surface of the second development roller 142. The developer 4 is transported by the second agitating member 148 to a side opposite to the second development roller 142, mixed with the developer 4 contained in the first agitating chamber 147, and then fed to the second development roller 142.

Configuration of Related Portion of Image Forming Apparatus

As illustrated in FIG. 1, in the image forming apparatus 1, in each of the image forming devices 10Y, 10M, 10C, 10K, 10S1, and 10S2 for yellow (Y), magenta (M), cyan (C), black (K) and the spot colors (S1 and S2), the developing device 14 develops the corresponding electrostatic latent image formed on the surface of the photoconductor drum 11 into a toner image. The toner images formed on the surfaces of the photoconductor drums 11 of the image forming devices 10Y, 10M, 10C, 10K, 10S1, and 10S2 are superposed on top of one another and first transferred to the intermediate transfer belt 21 by the first transfer device 15 at the first transfer position. Then, the toner images are second transferred by the second transfer device 30 from the intermediate transfer belt 21 to a recording medium 5 at the second transfer position.

Here, the transfer efficiency with which a toner image is transferred from the intermediate transfer belt 21 to a recording medium 5 at the second transfer position varies with the type of the recording medium 5. When a recording sheet 5 having projections and depressions on its surface, such as an embossed sheet, is used as an example of a recording medium, the transfer efficiency with which a toner image is transferred from the intermediate transfer belt 21 to the recording sheet 5 is low: part of the toner image might not be transferred to a depression of the sheet 5 from the intermediate transfer belt 21.

In the image forming apparatus 1, a toner having a small particle diameter is often used for improving the image quality. Thus, the diameter of the toner is relatively smaller than the size of the depressions of the recording sheet 5, thereby causing a problem in transfer of the toner. In view of this, for improvement of the transfer efficiency, an additive (transfer support additive) having a relatively large particle diameter is added to the toner of the two-component developer 4.

The inventors have studied and examined the reason why the transfer efficiency with which a toner image is transferred to the recording sheet 5, such as an embossed sheet, having projections and depressions on its surface is low from various aspects and found the following fact by investigating the transfer efficiency of a toner image by using a toner having a mean volume particle diameter of approximately 3.8 μm. Specifically, the amount of transfer support additive adhering to the toner varies between the cases where the toner image is successfully transferred to a depression of the recording sheet 5 and where the toner image fails to be transferred to a depression of the recording sheet 5.

Specifically, the surfaces of the toner particles used when toner images are successfully transferred to the depression of the recording sheet 5 and the surfaces of the toner particles used when toner images are not sufficiently transferred to the depression have been observed using a scanning electron microscope (SEM) and the additives on the toner particles for both cases have been compared. As a result, the additive adhering to the toner particles used when toner images are successfully transferred to the depression of the recording sheets 5 remain substantially unchanged from the initial state or only a little amount of additive comes off or is buried in the toner. On the other hand, on the surfaces of the toner particles used when toner images are not sufficiently transferred to the depression of the recording sheet 5, a larger amount of additive that have adhered to the toner particles comes off or is buried in the toner.

In other words, when a sufficiently large amount of additive is interposed between the intermediate transfer belt 21 and the toner at the second transfer position, the transfer efficiency with which a toner image is transferred from the surface of the intermediate transfer belt 21 to a recording medium 5 such as an embossed sheet is preferably high. On the other hand, when the amount of additive interposed between the surface of the intermediate transfer belt 21 and the toner particles is small, the transfer efficiency with which a toner image is transferred from the surface of the intermediate transfer belt 21 to the recording medium 5 such as an embossed sheet is low.

The toner image formed on the surface of the photoconductor drum 11 is first transferred to the intermediate transfer belt 21 at the first transfer position and then is transported to the second transfer position as it is. Thus, an amount of additive interposed between the intermediate transfer belt 21 and the toner is determined when the toner image is formed on the surface of the photoconductor drum 11, that is, determined by conditions under which the developing device 14 renders the electrostatic latent image formed on the surface of the photoconductor drum 11 visible.

Thus, how well the additive adhering to the surfaces of the toner particles is maintained while the developing device 14 develops an electrostatic latent image formed on the photoconductor drum 11 into a toner image markedly affects the degree of improvement of the transfer efficiency with which the toner image is transferred to the recording medium 5 having projections and depressions on its surface such as an embossed sheet.

The developing device 14 includes the first development roller 141 and the second development roller 142 to develop an electrostatic latent image formed on the surface of the photoconductor drum 11. In consideration of maintaining the amount of additive adhering to the surface of the toner particles, it seems that sliding friction between the surface of the photoconductor drum 11 and the developer 4 held on the surfaces of the first and second development rollers 141 and 142 significantly affects the amount of additive. At the facing portion 143 at which the first development roller 141 faces the photoconductor drum 11, the first development roller 141 moves in the direction opposite to the direction of movement of the surface of the photoconductor drum 11. On the other hand, at the facing portion 144 at which the second development roller 142 faces the photoconductor drum 11, the second development roller 142 moves in the same direction as the direction of movement of the surface of the photoconductor drum 11. Thus, the sliding friction between the surface of the photoconductor drum 11 and the developer 4 held on the surface of the first development roller 141 is larger than the sliding friction between the surface of the photoconductor drum 11 and the developer 4 held on the surface of the second development roller 142.

In view of this, the inventors have made a prototype of the image forming apparatus 1 illustrated in FIG. 1 and conducted the following experiments for improving the transfer efficiency with which a toner image is transferred to a recording medium 5 having projections and depressions on its surface such as an embossed sheet. Specifically, an image having 50% area coverage is consecutively printed on 1,000 sheets while the development conditions under which the first development roller 141 and the second development roller 142 of the developing device 14 perform development are changed in the manner, as described below. Then, the transfer efficiency with which the toner image is transferred from the intermediate transfer belt 21 to the embossed sheet is examined. Here, the transfer efficiency is determined by the proportion of the amount of toner transferred from the intermediate transfer belt 21 to the embossed sheet to the whole amount of toner and indicated in percentage. Leathac 66 is used as an example of the embossed sheet.

Among the development conditions under which the first development roller 141 and the second development roller 142 of the developing device 14 perform development, the amount of developer per unit area (hereinafter also called "MOS") held on the surface of each of the development rollers 141 and 142 and the shortest distance (hereinafter also called "DRS") between the photoconductor drum 1 and each of the development rollers 141 and 142 are changed for the experiments. Here, each MOS and each DRS are set so as to be different between the first development roller 141 and the second development roller 142.

Development Conditions

Amount of developer (MOS) on first development roller: 250 g/m$^2$ (comparisons between 250 g/m$^2$ and 310 g/m$^2$)

Amount of developer (MOS) on second development roller: 240 g/m$^2$ (comparisons ranging from 240 g/m$^2$ to 310 g/m$^2$)

Center of shortest distance (DRS) between first development roller and photoconductor drum: 180 μm (comparisons ranging from 140 μm to 240 μm)

Center of shortest distance (DRS) between second development roller and photoconductor drum: 200 μm (comparisons ranging from 130 μl to 250 μm)

Rotation speed (process speed) of photoconductor drum: 370 mm/sec

Rotation direction (MRS) of first development roller: same as rotation direction of photoconductor drum (or against direction) at peripheral velocity ratio of 1.75

Rotation direction (MRS) of second development roller: opposite to rotation direction of photoconductor drum (or with direction) at peripheral velocity ratio in a range from 1.5 to 2.0

Surface shape and surface roughness of development rollers: sleeves grooved at pitch of 0.8 mm Diameter Φ of development rollers: 25 mm Magnitude of magnetic force of development poles on development rollers: 100 to 159 mT DC component voltage included in voltage applied to first and second development rollers: −300 to −500 V Wave form of AC component voltage (development AC bias) superimposed on DC component voltage applied to first and second development rollers: sine wave (square wave)

Amplitude of development AC bias (Vp-p or peak to peak voltage): 500 to 1200 V

Frequency of development AC bias: 5 to 20 kHz

Examination Marks (Transfer Efficiency)

Good: above 95%

Fair: 90 to 95%

Poor: below 90%

Here, "good" denotes preferable, "fair" denotes acceptable, and "poor" denotes unacceptable.

FIG. 5 is a table showing the results of experiments.

As is clear from the table of FIG. 5, as to the first development roller 141, the amount of developer per unit area (hereinafter also called "MOS") held on the surface of the development roller 141 was set to 250 g/m$^2$ and 300 g/m$^2$ and the shortest distance (DRS) between the photoconductor drum 1 and the development roller 141 is changed between 140, 160, 180, 200, and 240 μm. In addition, as to the second development roller 142, the amount of developer per unit area (hereinafter also called "MOS") held on the surface of the development roller 142 is set to 240 g/m$^2$, 280 g/m$^2$, and 310 g/m$^2$, and the shortest distance (DRS) between the photoconductor drum 1 and the development roller 142 is changed between 130, 170, 180, 200, 240, and 250 μm.

When the MOS/DRS ratio obtained by dividing the amount of developer per unit area (MOS) held on the surface of the first development roller 141 by the shortest distance (DRS) between the photoconductor drum 1 and the first development roller 141 is 1.79 or 1.88×10$^3$ kg/m$^3$, transfer failure occurs. On the other hand, when the MOS/DRS ratio falls within a range from 1.04 to 1.56×10$^3$ kg/m$^3$, the transfer efficiency is preferable or acceptable.

As described above, when the MOS/DRS ratio obtained by dividing the amount of developer per unit area (MOS) held on the surface of the first development roller 141 by the shortest distance (DRS) between the photoconductor drum 1 and the first development roller 141 is in a range from 1.00×10$^3$ kg/m$^3$ to 1.60×10$^3$ kg/m$^3$, inclusive, it is found that the transfer efficiency with which the toner image is transferred to an embossed sheet having projections and depressions on its surface is capable of being maintained at a preferable or acceptable level.

More specifically, when the MOS/DRS ratio obtained by dividing the amount of developer per unit area (MOS) held on the surface of the first development roller 141 by the shortest distance (DRS) between the photoconductor drum 1 and the first development roller 141 is in a range from $1.00\times10^3$ kg/m$^3$ to $1.40\times10^3$ kg/m$^3$, inclusive, it is found that the transfer efficiency with which the toner image is transferred to an embossed sheet having projections and depressions on its surface is capable of being maintained at a preferable level.

In the developing device 14, when the amount of developer per unit area (MOS) held on the surface of the first development roller 141 falls within the range from 200 to 400 g/m$^2$, the shortest distance (DRS) between the photoconductor drum 1 and the first development roller 141 falls within the range from 100 to 400 μm, and a gap between the thickness regulating member 150 and the second development roller 142 falls within the range from 0.4 to 0.8 mm, it has been configured that results that are similar to those illustrated in FIG. 5 are obtained.

Second Exemplary Embodiment

Figure 6:
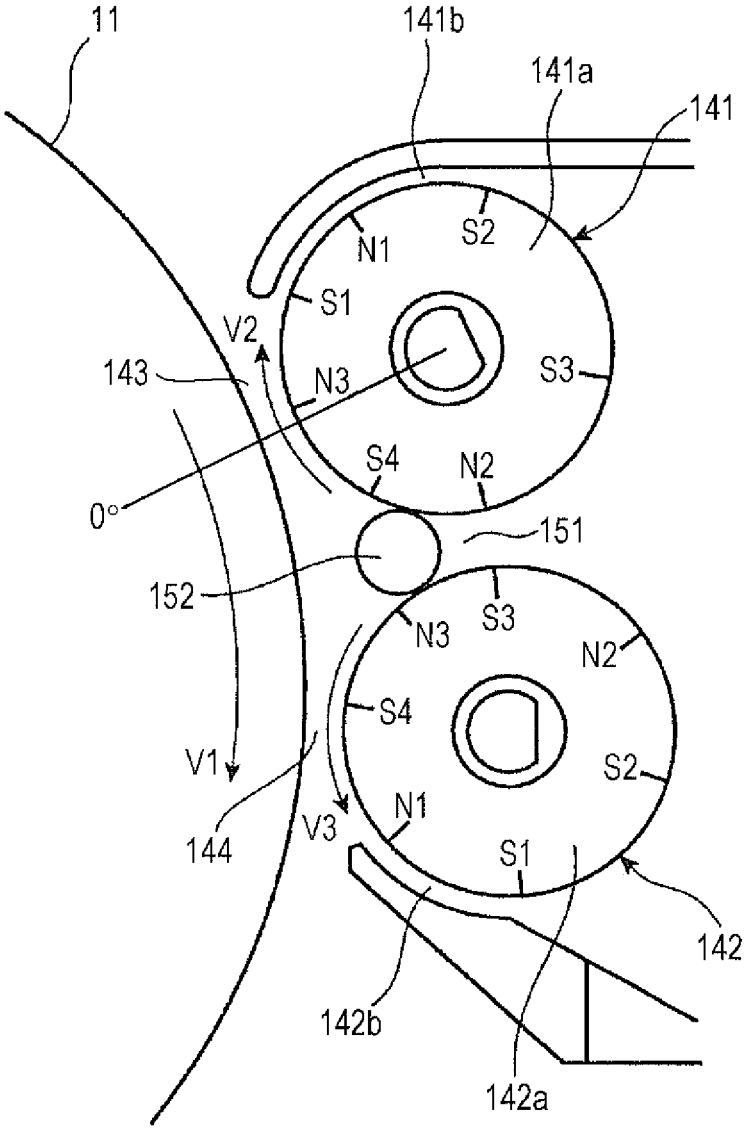
FIG. 6 illustrates a configuration of a developing device according to a second exemplary embodiment of the invention.

FIG. 6 illustrates a developing device according to a second exemplary embodiment.

Configuration of Developing Device

As illustrated in FIG. 6, in this second exemplary embodiment, when the peripheral velocity of the photoconductor drum 11 is denoted by V1, the peripheral velocity of the first development roller 141 is denoted by V2, and the peripheral velocity of the second development roller 142 is denoted by V3, the peripheral velocity ratio (V3/V1) of the second development roller 142 to the photoconductor drum 11 is made larger than the peripheral velocity ratio (V2/V1) of the first development roller 141 to the photoconductor drum 11.

FIG. 7 is a table showing results of experiments conducted to examine the transfer efficiency with which a toner image is transferred to an embossed sheet under the conditions the same as those in the case of the first embodiment as well as the following conditions: the peripheral velocity ratio (V2/V1) of the first development roller 141 to the photoconductor drum 11, which rotate in the same direction or against direction, is changed between 1.00 and 2.25 and the peripheral velocity ratio (V3/V1) of the second development roller 142 to the photoconductor drum 11, which rotate in the opposite direction or with direction, is changed between 1.5 and 4.00. In FIG. 7, "good" denotes preferable, "fair" denotes acceptable, and "poor" denotes unacceptable.

As is clear from FIG. 7, when the peripheral velocity ratio (V2/V1) of the first development roller 141 to the photoconductor drum 11 is 2.00 or lower, the transfer efficiency is at an acceptable or preferable level. On the other hand, when the peripheral velocity ratio (V2/V1) is 2.25 or higher, the transfer efficiency is at an unacceptable level. Thus, in order to prevent an additive from adhering to the surface of the photoconductor drum 11, it is only required to set the peripheral velocity ratio of the first development roller 141 to the photoconductor drum 11 to 2.00 or lower.

On the other hand, when the peripheral velocity ratio (V3/V1) of the second development roller 142 to the photoconductor drum 11 is 4.00 or lower, the transfer efficiency is at an acceptable or preferable level since the second development roller 142 and the photoconductor drum 11 move in the same direction at the facing portion. Thus, in order to prevent an additive from adhering to the surface of the photoconductor drum 11, it is only required to set the peripheral velocity ratio of the second development roller 142 to the photoconductor drum 11 to 4.00 or lower.

In addition, when the peripheral velocity ratio (V3/V1) of the second development roller 142 to the photoconductor drum 11 is set larger than the peripheral velocity ratio (V2/V1) of the first development roller 141 to the photoconductor drum 11, the development performance of the second development roller 142 is improved while sliding friction between the developer 4 held on the surface of the first development roller 141 and the photoconductor drum 11 is kept low.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a first developer holder disposed so as to face an image holding member that holds an electrostatic latent image, the first developer holder rotating while holding a developer on a surface thereof so as to move in a direction opposite to a direction of movement of the image holding member at a first facing portion at which the first developer holder faces the image holding member; and a second developer holder disposed downstream from the first developer holder in the direction of movement of the image holding member so as to face the image holding member, the second developer holder rotating while holding the developer on a surface thereof so as to move in a direction the same as the direction of movement of the image holding member at a second facing portion at which the second developer holder faces the image holding member, the first developer holder and the second developer holder each comprising a sleeve and a magnet that is fixed in the sleeve, the sleeves rotating while developing, and a rotating direction of the sleeve of the first developer holder being in a same direction as a rotation direction of the image holding member, wherein a value obtained by dividing an amount of developer per unit area held on the first developer holder by a shortest distance between the image holding member and the first developer holder is approximately in a range from $1.00\times10^3$ kg/m$^3$ to $1.60\times10^3$ kg/m$^3$, and wherein a value obtained by dividing an amount of developer per unit area held on the second developer holder by a shortest distance between the image holding member and the second developer holder is set to be larger than the value obtained by dividing the amount of developer per unit area held on the first developer holder by the shortest distance between the image holding member and the first developer holder.

2. The developing device according to claim 1, wherein the amount of developer per unit area held on the first developer holder is approximately in a range from 200 to 400 g/m$^2$ and the shortest distance between the image holding member and the first developer holder is approximately in a range from 100 to 400 μm.

3. The developing device according to claim 1, wherein the developer is a two-component developer including a carrier and a toner, wherein a specific gravity of the carrier is approximately in a range from 2 to $7\times10^3$ kg/m$^3$, and wherein an average diameter of particles of the carrier is approximately in a range from 10 to 40 μm.

4. The developing device according to claim 2, wherein the developer is a two-component developer including a carrier and a toner, wherein a specific gravity of the carrier is approximately in a range from 2 to $7\times10^3$ kg/m$^3$, and wherein an average diameter of particles of the carrier is approximately in a range from 10 to 40 μm.

5. The developing device according to claim 1, wherein the value obtained by dividing the amount of developer per unit area held on the first developer holder by the shortest distance between the image holding member and the first developer holder is approximately in a range from $1.00\times10^3$ kg/m$^3$ to $1.40\times10^3$ kg/m$^3$.

6. The developing device according to claim 2, wherein the value obtained by dividing the amount of developer per unit area held on the first developer holder by the shortest distance between the image holding member and the first developer holder is approximately in a range from $1.00\times10^3$ kg/m$^3$ to $1.40\times10^3$ kg/m$^3$.

7. The developing device according to claim 3, wherein the value obtained by dividing the amount of developer per unit area held on the first developer holder by the shortest distance between the image holding member and the first developer holder is approximately in a range from $1.00\times10^3$ kg/m$^3$ to $1.40\times10^3$ kg/m$^3$.

8. The developing device according to claim 4, wherein the value obtained by dividing the amount of developer per unit area held on the first developer holder by the shortest distance between the image holding member and the first developer holder is approximately in a range from $1.00\times10^3$ kg/m$^3$ to $1.40\times10^3$ kg/m$^3$.

9. The developing device according to claim 1, wherein a peripheral velocity ratio of the second developer holder to the image holding member is set to be larger than a peripheral velocity ratio of the first developer holder to the image holding member.

10. An image forming apparatus comprising:

an image holding member that holds an electrostatic latent image;

a charging unit that charges a surface of the image holding member;

an electrostatic latent image forming unit that forms an electrostatic latent image on the surface of the image holding member charged by the charging unit;

a developing unit that develops the electrostatic latent image formed on the surface of the image holding member into a toner image using a developer holder that holds a developer;

a transfer unit that transfers the toner image formed on the surface of the image holding member to a recording medium; and a fixing unit that fixes the toner image transferred to the recording medium, wherein the developing device according to claim 1 is used as the developing unit.

* * * * *